US006332453B1

(12) United States Patent
Yamakado et al.

(10) Patent No.: US 6,332,453 B1
(45) Date of Patent: Dec. 25, 2001

(54) ELECTROMAGNETIC SYSTEM FUEL INJECTION APPARATUS AN INTERNAL COMBUSTION ENGINE HAVING AN ELECTROMAGNETIC SYSTEM FUEL INJECTION APPARATUS, AND A DRIVE CIRCUIT OF AN ELECTROMAGNETIC SYSTEM FUEL INJECTION APPARATUS

(75) Inventors: Makoto Yamakado, Tsuchiura; Yoshio Okamoto, Minori-machi; Yzo Kadomukai, Ishioka; Yoshiyuki Tanabe, Hitachinaka; Hiromasa Kubo, Yokohama; Toshio Takahata, Atsugi; Kenji Tabuchi; Yasunaga Hamada, both of Hitachinaka, all of (JP)

(73) Assignees: Hitachi, Ltd., Tokyo; Hitachi Car Engineering Co., Ltd., Hitachinaka, both of (JP)

( * ) Notice: Subject to any disclaimer, the term of this patent is extended or adjusted under 35 U.S.C. 154(b) by 0 days.

(21) Appl. No.: 09/471,500

(22) Filed: Dec. 23, 1999

(30) Foreign Application Priority Data

Dec. 25, 1998 (JP) ..... 10-368953

(51) Int. Cl.[7] ..... F02M 51/00
(52) U.S. Cl. ..... 123/490

(58) Field of Search ..... 123/490, 472, 123/478, 480, 482; 355/256; 361/139

(56) References Cited

U.S. PATENT DOCUMENTS

| | | | | |
|---|---|---|---|---|
| 3,576,473 | * | 4/1971 | Genbauffe et al. | 361/194 |
| 3,665,898 | * | 5/1972 | Kamazuka | 123/490 |
| 4,355,619 | * | 10/1982 | Wilkinson | 123/490 |
| 4,377,144 | * | 3/1983 | Takahashi | 123/490 |
| 5,992,391 | * | 11/1999 | Yamakado et al. | 123/490 |

FOREIGN PATENT DOCUMENTS 8-326620 12/1996 (JP) .

* cited by examiner

*Primary Examiner*—Henry C. Yuen
*Assistant Examiner*—Mahmoud Gimie
(74) *Attorney, Agent, or Firm*—Antonelli, Terry, Stout & Kraus, LLP

(57) ABSTRACT

Using a control coil having a high response characteristic suited to valve opening and a hold coil suited to a hold to valve open during fuel injection using a small current, during the valve opening time, a high voltage is applied to the control coil suited to the valve opening operation and, during the time the valve is to be held open a low and stabilized voltage is applied to the hold coil. In a fuel injection apparatus, drive manner employed during a valve opening time and a valve hold time is optimized.

12 Claims, 12 Drawing Sheets

MUTUAL INDUCTION ELECTROMOTIVE FORCE AND EQUIVALENT CIRCUIT

REVERSE CURRENT FLOW PATH

THROW-IN CURRENT OF CIRCUIT HAVING NO REVERSE FLOW PREVENTION DIODE

THROW-IN ELECTROMAGNETIC FORCE OF CIRCUIT HAVING NO REVERSE FLOW PREVENTION DIODE

THROW-IN CURRENT OF CIRCUIT HAVING REVERSE FLOW PREVENTION DIODE

THROW-IN ELECTROMAGNETIC FORCE OF CIRCUIT HAVING REVERSE FLOW PREVENTION DIODE

ELECTROMAGNETIC SYSTEM FUEL INJECTION APPARATUS AN INTERNAL COMBUSTION ENGINE HAVING AN ELECTROMAGNETIC SYSTEM FUEL INJECTION APPARATUS, AND A DRIVE CIRCUIT OF AN ELECTROMAGNETIC SYSTEM FUEL INJECTION APPARATUS

BACKGROUND OF THE INVENTION

The present invention relates to an electromagnetic fuel injection apparatus, an internal combustion engine having an electromagnetic fuel injection apparatus, and a drive circuit of an electromagnetic fuel injection apparatus. More particularly, the invention relates to an electromagnetic fuel injector comprising at least two coils for driving a valve body, and it also relates to an internal combustion engine having an electromagnetic fuel injector, and a drive circuit for an electromagnetic fuel injector.

An electromagnetic fuel injector (hereinafter simply called an injector) has a structure in which an electric signal is applied to a coil provided inside the injector, and, in response to a generated magnetic force, a plunger is moved to separate a valve body from a valve seat so that a fuel passage between the valve body and the valve seat is opened to allow fuel to be injected from a fuel injection orifice.

In the above-stated injector, as a means for forcing the valve body toward the valve seat in the closing direction, a return spring ember is provided, so that when application of the electric signal to the oil is stopped, the magnetic attraction force which moves the plunger in the opening direction is attenuated, and the fuel passage between the valve body and the valve seat is closed, namely the injector is closed.

In Japanese application patent laid-open publication No. Hei 8-326620, an electromagnetic fuel injector is disclosed, in which two coils are provided. At an initial stage of a valve opening operation, where a closed valve state is shifted to a valve opening operation application of electric signals to the two coils is performed; which, after the valve has opened, only one coil is energized to hold the valve open. In this conventional injector, each of the above-stated two coils is formed to have the same size and the same configuration. In this conventional injector, by the application of electrical signals to the two coils during the valve opening operation, the magnetic attraction force is made large and the valve opening delay can be shortened; and, during the time the valve is being held open, the magnetic attraction force is small, and so the valve closing delay time can be shortened.

In the conventional injector disclosed in Japanese application patent laid-open publication No. Hei 8-326620, as stated above, no consideration is given to the possibility that advantages can be achieved of the electric characteristic of the two coils is designated to be different from one another. For this reason, there are problems in that, when an attempt is made to assure a high speed response performance during valve opening, it is difficult to obtain a magnetomotive force necessary to maintain the valve in the open condition; on the other hand, when an attempt is made to assure a stable performance during the time the valve is held open, it is difficult to obtain a high speed response performance.

Accordingly, in the above-stated conventional injector, it is not easy to design a structure in which the high speed response performance is compatible with the stability performance during the time the valve is being held open for fuel injection.

SUMMARY OF THE INVENTION

An object of the present invention is to provide an electromagnetic fuel injection apparatus, an internal combustion engine having an electromagnetic fuel injection apparatus, and a drive circuit of an electromagnetic fuel injection apparatus, wherein a drive force of a desirable characteristic for control of a valve body of the electromagnetic fuel injection apparatus can be generated to effect operation of the electromagnetic fuel injection apparatus.

To attain the above-stated object, an electromagnetic fuel injection apparatus, comprising an electromagnetic fuel injector and a drive circuit for driving the electromagnetic fuel injector is provided, wherein the electromagnetic fuel injector has at least two coils having a different time change rate of magnetomotive force, and to the at least two coils, a different voltage is applied.

Further, to attain the above stated object, an electromagnetic fuel injection apparatus, comprising an electromagnetic fuel injector and a drive circuit for driving the electromagnetic fuel injector, is provided, wherein the electromagnetic fuel injector has at least two coils having a different winding number, and to the at least two coils, a different voltage is applied.

Further, to attain the above-stated object, an electromagnetic fuel injection apparatus, comprising an electromagnetic fuel injector and a drive circuit for driving the electromagnetic fuel injector, is provided, wherein the electromagnetic fuel injector has at least two coils having a different length, and to the at least two coils, a different voltage is applied.

Further, to attain the above-stated object, an electromagnetic fuel injection apparatus, comprising an electromagnetic fuel injector and a drive circuit for driving the electromagnetic fuel injector, is provided, wherein the electromagnetic fuel injector has at least coils having a different cross-sectional area of wire material, and to the at least two coils, a different voltage is applied.

Further to attain the above-stated object, an electromagnetic fuel injection apparatus, comprising an electromagnetic fuel injector and a drive circuit for driving the electromagnetic fuel injector, is provided, wherein the electromagnetic fuel injector at least two coils having a different electric resistance value between the terminals thereof, and to the at least two coils, a different voltage is applied.

In the above-stated electromagnetic fuel injection apparatus, to one of the at least two coils, which has a large time change rate of magnetomotive force, a high voltage is applied, and to another of the at least two coils, which has a small time change rate of magnetomotive force, a low voltage is applied.

Further, to attain the above-stated object, an electromagnetic fuel injection apparatus, comprising an electromagnetic fuel injector and a drive circuit for driving the electromagnetic fuel injector, is provided, wherein the fuel injector has a fuel injection orifice, a seat valve provided upstream of the fuel injection orifice, a valve body for performing an opening and closing of a fuel passage between the valve seat and the valve body, and at least two coils for generating a drive force of the valve body. In the electromagnetic fuel injector, there is provided a first coil having a large time change rate of magnetomotive force, which is a product of the winding number and a current value, and a second coil having a smaller time change rate of magnetomotive than that of the first coil, and a switching means is connected to the first coil for performing an on and an off application of a first voltage, and a second switching means is connected to the second coil, for performing an on and off application of a second voltage lower, than the first voltage.

Further, to attain the above-stated object, an electromagnetic fuel injection apparatus, comprising an electromagnetic fuel injector, a drive circuit for driving the electromagnetic fuel injector and a control circuit for sending a control signal to the drive circuit, is provided wherein the electromagnetic fuel injector has a fuel injection orifice, a seat valve provided upstream of the fuel injection orifice, a valve body for performing an opening and closing of a fuel passage between the valve seat and the valve body, and at least two coils for generating a drive force to effect movement of the valve body wherein a first coil has a large time change rate of magnetomotive force, which is a product of the winding number and a current value, and a second coil has a smaller time change rate of magnetomotive than that of the first coil. In the drive circuit, for controlling the first coil, a switching means is provided for performing an on and off application of a first voltage, and for controlling the second coil, a second switching means is provided for performing an on and off application of a second voltage lower than the first voltage. In the control circuit, at an initial stage of the valve opening operation of the valve body, a first voltage is sent to the first coil and a second voltage is sent to the second coil to generate a magnetic flux having the same direction, and, after that, only the second voltage is sent to the second coil.

In the above-stated electromagnetic fuel injection apparatus, a circuit means for regulating the second voltage is provided.

In the above-stated electromagnetic fuel injection apparatus, the drive circuit is installed inside of an engine control unit which controls an operation condition of an internal combustion engine.

Further, to attain the above-stated object, an internal combustion engine has an electromagnetic fuel injection apparatus according to the present invention for injecting fuel, a fuel supply means for supplying the fuel to the fuel injection apparatus, a plurality of cylinders in which the fuel injected by the fuel injection apparatus is burned, an air intake means for supplying air to the cylinders, an ignition means for igniting an air-fuel mixture in each cylinder, an air exhaust means for exhausting gas from each cylinder, and an engine control unit for controlling the air intake means, the air exhaust means, the ignition means and the fuel injection apparatus. The electromagnetic fuel injection apparatus comprises an electromagnetic fuel injector and a drive circuit for driving the electromagnetic fuel injector, and the electromagnetic fuel injector has a fuel injection orifice, a seat valve provided upstream of the fuel injection orifice, a valve body for performing an opening and closing of a fuel passage between the valve seat and the valve body, and at least two coils for generating a drive force to effect movement of the valve body, including a first coil having a large time change rate of magnetomotive force, which is a product of the winding number and a current value, and a second coil having a smaller time change rate of magnetomotive than that of the first coil. In the drive circuit, to control the first coil, a switching means is provided for performing an on and off application of a first voltage, and to control the second coil, a second switching means is provided for performing an on and off application of a second voltage lower than the first voltage.

Further, to attain the above-stated object, an internal combustion engine has an electromagnetic fuel injection apparatus according to the present invention for injecting fuel, a fuel supply means for supplying the fuel to the fuel injection apparatus, a plurality of cylinders in which the fuel injected by the fuel injection apparatus is burned, an air intake means for supplying air to the cylinders, an ignition means for igniting an air-fuel mixture in each cylinder, an air exhaust means for exhausting gas from each cylinder, and an engine control unit for controlling the air intake means, the air exhaust means, the ignition means and the fuel injection apparatus. The electromagnetic fuel injection apparatus includes an electromagnetic fuel injector and a drive circuit for driving the electromagnetic fuel injector, and the electromagnetic fuel injector has a fuel injection orifice, a seat valve provided upstream of the fuel injection orifice, a valve body for performing an opening and closing of a fuel passage between the valve seat and the valve body, and at least two coils for generating a drive force to effect movement of the valve body, including a first coil having a large time change rate of magnetomotive force, which is a product of the winding number and a current value, and a second coil having a smaller time change rate of magnetomotive than that of the first coil. There is provided a first power supply for supplying a first voltage to the first coil and a second power supply for supplying a second voltage to the second coil, the first voltage being a high voltage supplied to the first coil and the second voltage being a lower voltage than the first voltage of the first power supply and being supplied to the second coil to stabilize the operation of the fuel injection apparatus.

Further, to attain the above-stated object, in an electromagnetic fuel injection apparatus comprising a valve seat, a valve body for performing an opening and a closing of a fuel passage between said valve seat and the valve body, a coil, and a drive means for driving said valve body to effect opening and closing of said fuel passage to control fuel injection, the drive circuit of the electromagnetic fuel injection apparatus has a reverse flow prevention diode for preventing reverse current flow in a coil at the time of application of a voltage as a result of a mutual inductance.

DESCRIPTION OF THE INVENTION

Hereinafter, an electromagnetic fuel injection apparatus and an internal combustion engine having an electromagnetic fuel injection apparatus according to the present invention will be explained with reference to the drawings.

Figure 1B:
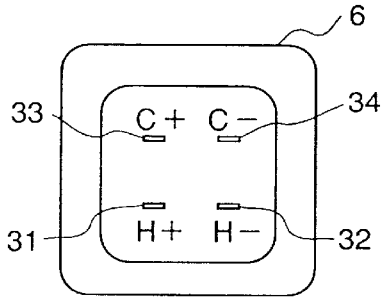
FIG. 1B is a detailed view showing a connector portion of the electromagnetic system fuel injection apparatus shown in FIG. 1A according to the present invention.
Figure 1A:
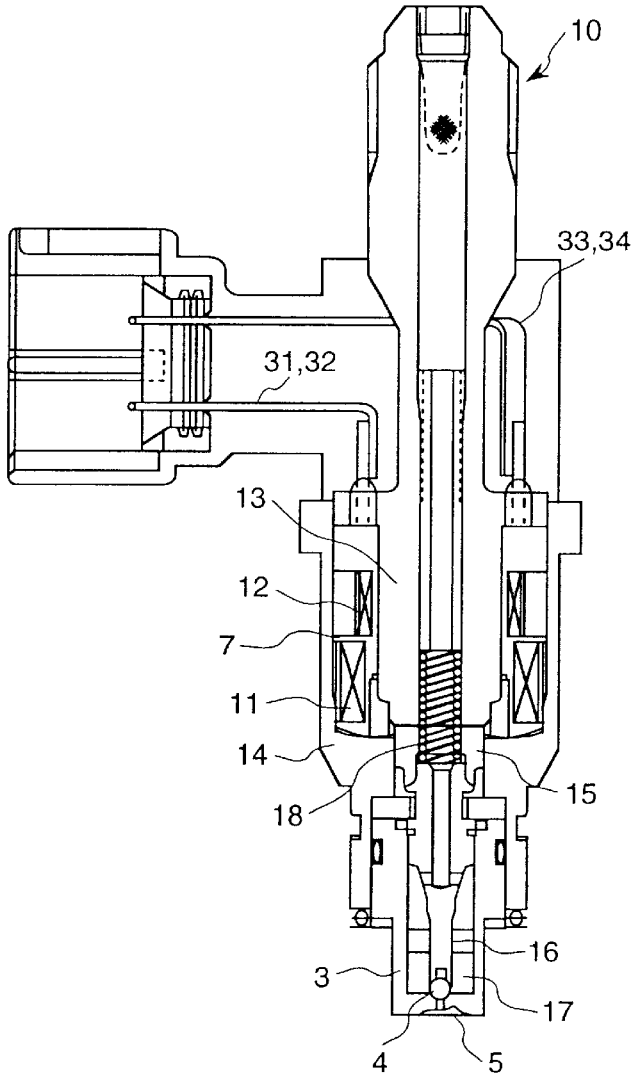
FIG. 1A is a cross-sectional view showing an electromagnetic system fuel injection apparatus representing one embodiment according to the present invention.

FIG. 1A shows a side cross-sectional view of an electromagnetic fuel injection apparatus (an injector) 10 according to the present invention, and FIG. 1B is a view taken from a left direction (a connection terminal face side of a connector) of the injector 10 as seen in FIG. 1A.

Figure 2A:
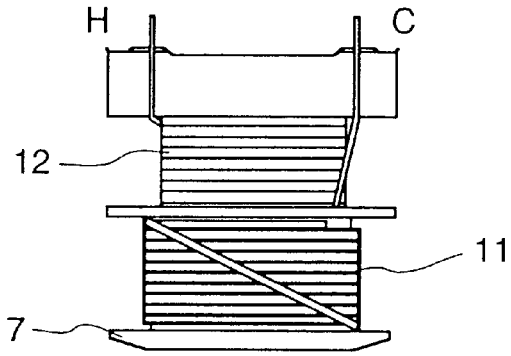
FIG. 2A is a side view showing a bobbin to which two coils of the electromagnetic fuel injection apparatus are wound according to the present invention.
Figure 2B:
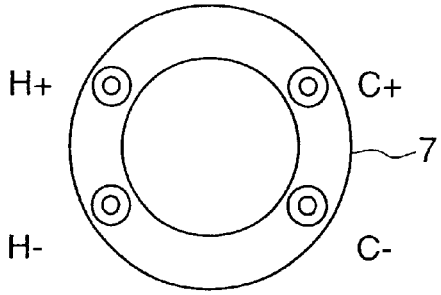
FIG. 2B is a plan view showing the bobbin of the electromagnetic fuel injection apparatus shown in FIG. 2A according to the present invention.
Figure 3:
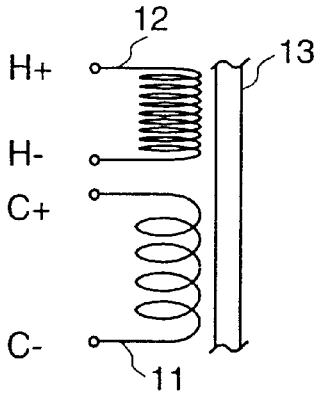
FIG. 3 is a schematic diagram showing an equivalent circuit of the electromagnetic fuel injection apparatus according to the present invention.

FIG. 2A is a view taken from the side of two coils, comprised of a control coil and a hold coil, which are wound on a bobbin provided in the injector 10, and FIG. 2B is a view taken from an upper portion (an opposite side of a fuel injection orifice of the injector 10 in the direction of the shaft center of the valve) of the bobbin of FIG. 2A. FIG. 3 is an equivalent circuit diagram of the injector 10 of this embodiment according to the present invention.

First of all, the structure of the injector 10 of this embodiment according to the present invention will be explained with reference to FIG. 1A and FIG. 1B. In the injector 10, fuel which is pressurized by a fuel pump is supplied to a fuel passage, and an opening and a closing of the fuel passage is carried out between a ball valve carried on a valve body 16 and a seat face (a valve seat face) 4 formed on one side of a nozzle 3, so that an injection amount of the fuel from a fuel injection orifice 5, which is formed at a side downstream of the seat face 4, is controlled.

The ball valve body 16 is coupled to a tip end of a plunger 15, and, on the side upstream of the seat face 4, a swirler 17 (a fuel swirling element) having a fuel passage for giving a swirling force to the fuel is provided. Using this swirler 17, an atomization of the fuel which is injected from the fuel injection orifice 5 is promoted.

To drive this ball valve body 16, a control coil 11 and a hold coil 12 are provided in the injector 10. When the control coil 11 and the hold coil 12 are supplied with a voltage, a magnetic flux is generated, which passes through a magnetic path consisting of a core 13, a yoke 14, and the plunger 15, and an attraction force is generated between the core 13, the yoke 14, and the plunger 15. Accordingly, the plunger 15 and the ball valve 16 are displaced toward an upper side (in a direction for separating the ball valve from the seat face 4) in this figure and the fuel is allowed to pass through the fuel passage which is opened between the seat face 4 and the ball valve, so that fuel is injected from the fuel injection orifice 5.

Further, in the injector 10, when an attraction force is not generated by the control coil 11 and the hold coil 12, in order to make the valve close by pushing the plunger 15 to cause the ball valve 16 to press against to the seat face 4, a forcing means is provided. In this embodiment according to the present invention, as the forcing means, a return spring member 18 is provided.

As shown in FIG. 1A, FIG. 1B and FIG. 2A and FIG. 2B, the control coil 11 and the hold coil 12 are wound on a bobbin 7. Both ends of the control coil 11 penetrate the bobbin 7 and are led to an upper side of a connector 6 through long terminals 33 and 34, and these long terminals 33 and 34 form a C+ terminal and a C− terminal, respectively. Similarly, both ends of the hold coil 12 penetrate the bobbin 7 and are led to a lower side of the connector through short terminals 31 and 32, and the short terminals 31 and 32 form a H+ terminal and a H− terminal, respectively.

When the H+ terminal and the C+ terminal are supplied with a positive voltage, and the H− terminal and the C− terminal are connected to a minus terminal of a battery, the control coil 11 and the hold coil will generate a magnetic flux in the same direction, as determined by the winding manner and the wiring manner of the control coil 11 and the hold coil 12. As shown in FIG. 3, an injector portion of this embodiment according to the present invention is shown as an equivalent circuit in which the control coil 11 and the hold coil 12 are wound. Hereinafter, the wiring manner and the current direction etc. of the injector 10 will be explained by reference to the equivalent circuit shown in FIG. 3.

The injector 10 of this embodiment according to the present invention, as stated above, has two coils, including the control coil 11 and the hold coil 12. In connection with the control coil 11, it is unnecessary to take into consideration the magnetomotive force necessary to maintain the valve in the open condition, but it is necessary only to take into consideration the raising characteristic of the magnetomotive force. On the other hand, the hold coil 12 is designed to generate the magnetomotive force necessary to maintain the valve in the open condition at a time when the valve opening condition is assured to some degree, and so it is unnecessary to take into consideration a high speed raising characteristic in connection with the operation of this coil.

In the injector 10 of this embodiment according to the present invention, the control coil 11 and the hold coil 12 are constituted to have different electric characteristics. The control coil 11 has a small winding number (an inductance) and a small electric resistance. On the other hand, the hold coil 12 has a large winding number and a large electric resistance. Further, the control coil 11 has a shorter length of wire material and a large cross-sectional area relative to the hold coil 12, and so the control coil 11 has a smaller electric resistance.

For the control coil 11 and the hold coil 12, the roles in the respective stages of valve closing, valve opening, holding the valve open, and then closing the valve again are different. The control coil 11 is, in the injector 10 of this embodiment according to the present invention, a coil which is used exclusively at the time of initial valve opening, and the hold coil 12 is a coil which is used for holding the valve open. Hereinafter, the respective current characteristics of the control coil 11 and the hold coil 12 will be explained.

Figure 4A:
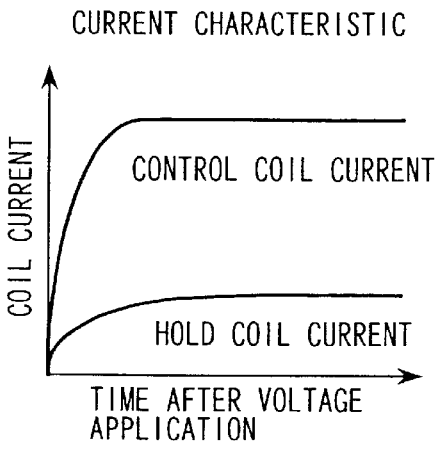
FIG. 4A is a graph showing a current characteristic of a control coil and a hold coil of the electromagnetic fuel injection apparatus according to the present invention.

FIG. 4A is a view showing the current characteristics of the currents flowing in the control coil 11 and the hold coil 12 for a case in which the same voltage V is applied over a predetermined time period. As stated above, since the control coil 11 has a small winding number and a small resistance, in a short time the current flowing therein can reach a large current value.

On the other hand, since the hold coil 12 has a large winding number and a large resistance, it takes a longer time for the current flowing therein to reach a converging current value, although the convergence value of the hold coil 12 is smaller than that of the control coil 11.

Figure 4B:
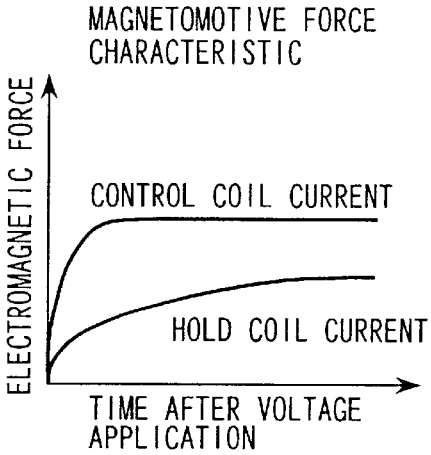
FIG. 4B is a graph showing a magnetomotive force response characteristic of the control coil and the hold coil of the electromagnetic system fuel injection apparatus according to the present invention.

FIG. 4B is a view showing the magnetomotive force response which affects the magnetic circuit formed of the respective coils 11 and 12. The magnetomotive force is expressed as a product of the coil winding number and the current value, and this is considered as a physical value which exerts an influence directly, upon the magnetic attraction force. As shown in FIG. 4A, the current which flows into the control coil 11 rises abruptly, but since the winding number is small, the convergence value of the magnetomotive force in the control coil 11 is not larger than the difference in the current value in comparison with that of the hold coil 12. Inversely, the magnetomotive force response of the hold coil 12 is duller than that of the control coil 11.

During the valve opening operation time, since a set load provided by the force of the return spring member 18 and the fuel pressure of the pressurized fuel is applied to the ball valve, in comparison to the valve opening hold time, a large electromagnetic attraction force is required. When the electromagnetic attraction force reaches a valve sufficient to overcome these forces, the plunger 15 starts to move.

In opening the valve, since the time necessary to generate the necessary electromagnetic attraction force has an influence on the valve opening delay, and since it is necessary to make this delay as short as possible, it is desirable to apply as high a voltage as possible to the control coil 11. For example, when an automobile has two power supply systems, including a 42V high voltage power supply and 14V low stabilization power supply, it is desirable to drive the control coil 11 with the 42V high voltage power supply. Further, in the coil used for the valve opening operation, it is effective to obtain the necessary magnetomotive force by means of the current rather than by setting the winding number.

In a case of the control coil 11 having a small winding number, since the inductance and the internal resistance are small, the current can flow easily. Namely, it is desirable to have the characteristic of the control coil 11 which is used in a peak hold system. Further, the easy flowability of the current is affected by not only the control coil 11 in the injector 10, but also by the internal resistance of a drive circuit, the resistance of the switching device and a drop in the voltage. As a result, it is necessary to make the internal resistance of the drive circuit, the resistance of the switching device and the drop in voltage as small as possible.

On the other hand, during the valve opening hold operation of the injector 10, in comparison with the valve opening operation, only a small magnetomotive force is needed to hold the valve body in the open condition. This is due to the fact that, with the valve open and the fuel being injected, the pressure on the upstream side and the downstream side of the ball valve is balanced, so that the force on the plunger by the fuel pressure is small. At the same time, since an air gap between the core 13, the yoke 14 and the plunger 15 becomes small, the magnetic flux density of the air gap is raised and the magnetomotive force can be used effectively.

Further, at the time of the valve closing of the injector 10 following the time the valve is held open, the application of voltage is stopped, then the magnetomotive force holding the valve open begins to fall and the magnetic force lowers. When the magnetic force becomes lower than the set load of the spring member 18, the valve closing operation in the injector 10 begins. Thus, when the magnetomotive force used to hold the valve open is excessive, this contributes to a valve closing delay. Accordingly, during the time the valve of the injector 10 is held open, it is necessary to employ a low magnetomotive force, which is near the stable hold limitation. To obtain this, the application of a stable low voltage to the injector 10 is effective.

To generate a stable attraction force in the injector 10, it is desirable to drive the coils with a stable power supply and to use a coil characteristic in which the current change is slow. To obtain this, it is desirable to employ a coil characteristic such as used in a saturated system in which the current control circuit is unnecessary.

Further, during the time the valve is being held open, in which the response performance of the attraction force is not required, it is unnecessary to use a high application voltage. When the valve is being held in the open condition, the consumption of electric power is a value equal to the square of the application voltage divided by the coil resistance. The coil resistance is proportional to the winding number of the coil and is inversely proportional to the wire diameter of the coil, however there are limitations to the increase of the winding number and the thinness of the wire diameter. To saturate actually the wire diameter and the copper wire, during the time the valve is being held open, it is desirable to apply a lower voltage than the voltage which is applied during the valve opening time.

During the time the valve of the injector 10 is being held open, when the voltage which is applied to the coil fluctuates, it is necessary to select a coil which will generate an attraction force sufficient to hold the valve open with the minimum voltage in the fluctuation range, because in the typical fluctuation range, the maximum voltage produces an attraction force which is excessive.

Further, when consideration is given to the heat generation, it is necessary to select a coil which will not overheat at the maximum voltage in the fluctuation range. However, at the maximum voltage in the fluctuation range, the attraction force is excessive, and due to this excess (unnecessary) attraction force, it is necessary to select a coil which will not cause the heat generation to be excessive. As a result, it is desirable to limit the fluctuation width and to stabilize the voltage applied to the coil during the time the valve is being held open. Accordingly, the coil is optimized from the attraction force aspect and the thermal aspect.

For example, in the case where the automobile has two power supplies comprised of a 42V high voltage power supply and a 14V low voltage stabilization power supply, during the time the valve of the injector 10 is being held open, it is desirable to use a power supply in which the 14V low voltage, being lower than the 42V high voltage, is stabilized. On the other hand, during the valve opening time of the injector 10, it is necessary to attenuate abruptly the magnetic force. In this case it is desirable to employ the coil characteristic which is used in a peak hold system.

Figure 5:
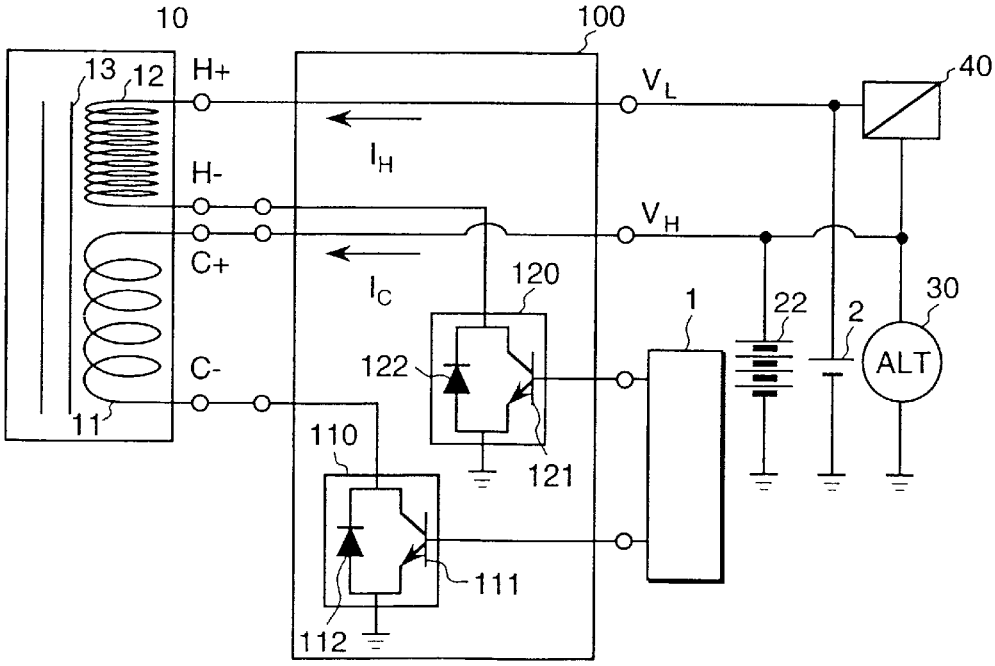
FIG. 5 is a schematic diagram showing a circuit wiring construction of the electromagnetic fuel injection apparatus according to the present invention.

FIG. 5 is a view showing the drive circuitry of the electromagnetic fuel injection apparatus of this embodiment according to the present invention, to which the above-stated features are applied.

As stated above, in the case where the automobile has two power supply systems, for example, comprised of a power supply providing a high voltage of 42V in the form of a battery 22 and a power supply providing a low voltage of 14V in the form of a battery 2, to supply a high voltage to the control coil 11, it is effective to use the voltage from the battery 22 (for example 42V). To supply a low voltage to the hold coil 12, it is effective to use the voltage from the battery 2 (for example 14V).

According to the function of the control coil 11, the hold coil 12, the first power supply 22, and the second power supply 2, it is possible to optimize the coil characteristics, such as the coil winding number, the coil resistance, and the coil wire diameter. At the same time, it is desirable to stabilize the second power supply 2 which provides having the low voltage. As a result, by providing a stable attraction force, it is possible to hold the valve body, and it is also possible to stabilize the injection characteristic of the injector 10.

The electromagnetic fuel injection apparatus of this embodiment according to the present invention is constituted by the injector 10 and a drive circuit 100 for driving the injector 10. According to the circumstances, it can also include a control circuit for controlling the injection timing of the injector 10. Further, the control circuit typically is provided in an interior portion of an engine controller (an engine control unit: ECU) 1.

Two voltages, including a voltage VH which is generated by an alternator 30 and a voltage VL which is stabilized at a low voltage lower than the voltage VH by DC/DC converter 40, are supplied to the injector drive circuit 100 in accordance with an injection command signal from the engine controller (the engine control unit: ECU) 1, according to which the application of respective voltages to the control coil 11 and the hold coil 12 is carried out.

The injector drive circuit 100 includes a control coil transistor module 110, which carries out the control of application of a voltage to the control coil 11, and a hold coil transistor module 120, which carries out the control of application of a voltage to the hold coil 12. The respective transistor modules 110 and 120 of the injector drive circuit 100 are constituted by power transistors 111 and 121, and surge absorption diodes 112 and 122.

When the control coil power transistor 111 is switched to an "on" state, the control coil 11 is supplied with the high voltage VH, and when the hold coil power transistor 121 is switched to an "on" state, the hold coil 12 is supplied with the stabilized low voltage VL. When these voltages are applied to the control coil 11 and the hold coil 12, magnetic flux is generated in the same direction in the control coil 11 and the hold coil 12 of the magnetic circuit, causing a force to be applied for attracting the plunger 15.

Figure 6:
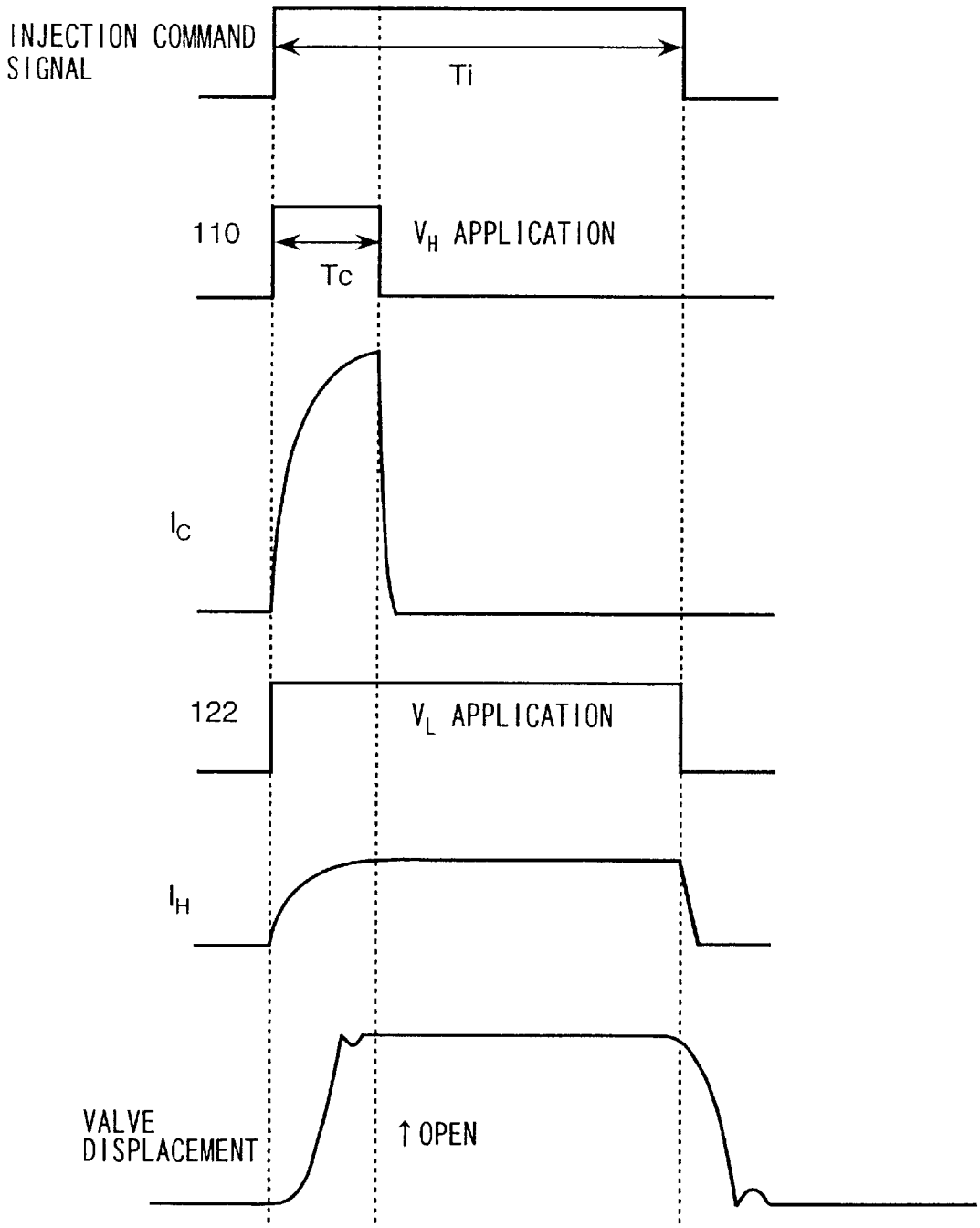
FIG. 6 is a waveform diagram showing injector drive of the electromagnetic fuel injection apparatus according to the present invention.

FIG. 6 is a timing diagram of the injector drive of the electromagnetic fuel injection apparatus of this embodiment according to the present invention. In response to the injection command signal having a length Ti, a high voltage VH is applied to the control coil 11 for a time period Tc (<Ti), and in that short time, a large magnetomotive force is generated in the control coil 11 and the valve opening of the injector 10 is effected. On the other hand, the low voltage VL, which is stabilized at the time of the injection command signal, is continuously applied to the hold coil 12 for the full period (Ti), in response to the injection command signal, and the application of the stabilized low voltage VL is stopped at the end of the injection period (Ti).

Since the open state of the electromagnetic fuel injection apparatus is held by the stabilized low voltage VL with a low magnetomotive force which is near the hold limitation, when application of the voltage VL is stopped, the valve body will quickly begin to move toward the valve closing position of the injector 10.

Figure 7A:
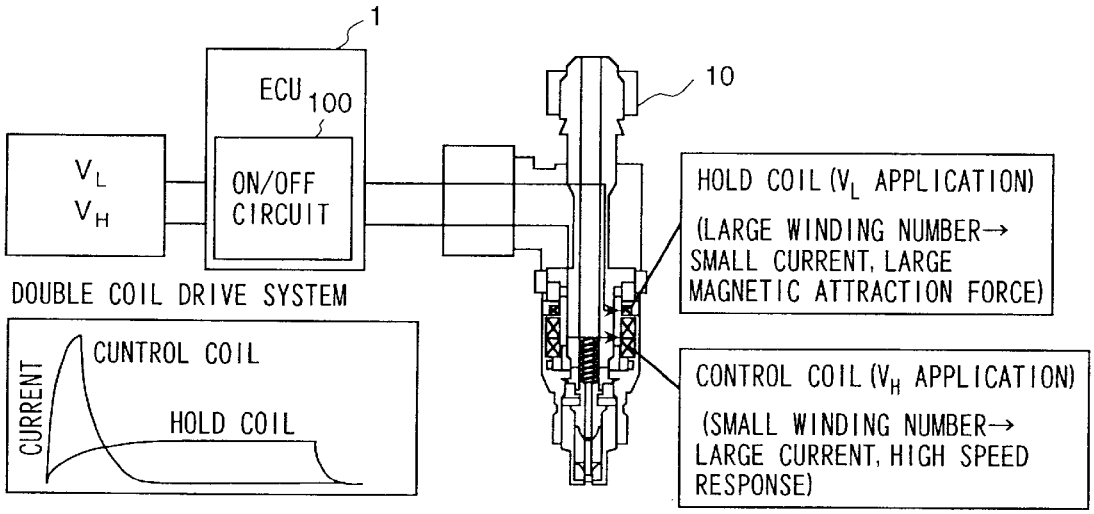
FIG. 7A is a diagram showing a simple model of the electromagnetic fuel injection apparatus according to the present invention.

As shown in FIG. 7A, in the electromagnetic fuel injection apparatus of this embodiment according to the present invention, the control coil 11 has a characteristic such that the winding number is small, a large current flows in a short time and a high speed response is provided, and to this control coil 11, the high voltage VH is applied. Further, as also shown in FIG. 7A, in the electromagnetic fuel injection apparatus of this embodiment according, to the present invention, the hold coil 12 has a characteristic such that a small current the stabilized attraction force enable to carry out is given to the hold coil 12, and to this hold coil 12, the stabilized low voltage VL is applied.

In the respective stages of the valve opening operation of the injector 10 and during the time the valve of the injector 10 is held open, since with the ideal coil characteristic and the ideal voltage are combined, it is possible to carry out an optimum operation of the injector 10.

Figure 7B:
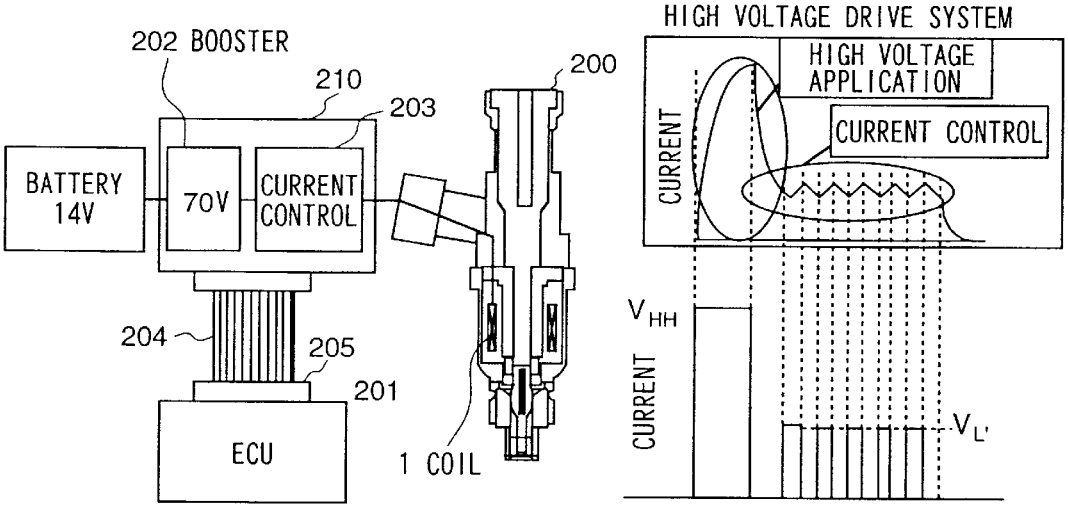
FIG. 7B is a diagram showing a simple model of a high voltage drive electromagnetic system fuel injection apparatus according to the prior art.

On the other hand, FIG. 7B shows the operation of a high voltage drive electromagnetic fuel injection apparatus according to the prior art. In the high voltage fuel injector, since only one coil is used to effect the valve opening operation and hold the valve open, it is difficult to obtain the ideal characteristic in the respective stages. For example, to obtain a good response performance during the valve opening operation time, similar to the control coil 11 of the embodiment according to the present invention, the coil winding number is small and the coil resistance is small, so that during the valve opening hold time, since it is necessary to continuously maintain a large current flow, the heat generation becomes excessive. On the other hand, if the winding number and the resistance are formed like those of the hold coil 12 of this embodiment according to the present invention, then it is impossible to quickly carry out the valve opening, and the valve opening delay becomes very large. For these reasons, a compromise in the design of the coil is necessary.

In the high voltage drive fuel injector according to the prior art, a very large voltage VHH (>>VH) is supplied from a battery using a step-up circuit 202, and, when this voltage is applied to the coil, the current is raised abruptly and the valve opening is carried out. After the valve opening of the injector, a battery voltage VLI (<<VHH) is applied directly, since the current flows to excess, the reduced voltage being produced by a current control circuit 203 using a switching operation, to make the current value constant within the hold limitation of the coil.

The scale of the step-up circuit 202 and the current control circuit 203 is large, and so it is impossible to arrange them in the conventional engine control unit. For this reason, in the high voltage drive fuel injection apparatus according to the prior art, the injector drive circuit 210 is arranged separately from the engine controller (the engine control unit: ECU) 201. Due to the employment of a separate arrangement for the injector drive circuit 210 and the engine controller 201, it is necessary to provide an additional housing for the fuel injector drive circuit 210.

Further, to transfer the signal from the engine controller 201, it is necessary to provide a harness 204 and a connector 205. Thus, to prevent the switching noises generated during the current control circuit drive time from undesirably influencing the engine controller 201 or car radio, etc., it is necessary to use a high cost shield wire.

Herein, as shown in FIG. 5, since the scale of the drive circuit of the electromagnetic fuel injection apparatus of this embodiment according to the present invention is constituted basically of an ON/OFF circuit comprised of two power transistors, it is very low in cost and is compact. Further, since a switching operation is unnecessary, noises do not occur. As a result, it is possible to house the injector drive circuit 100 in the interior portion of the engine controller (the engine control unit) 1.

Figure 7C:
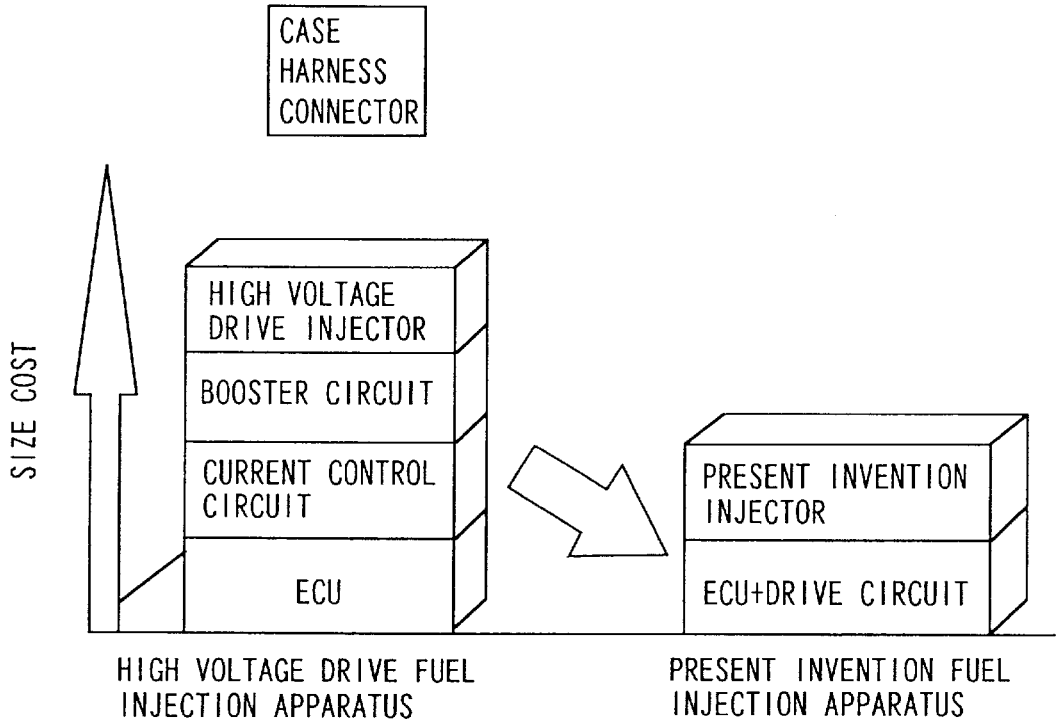
FIG. 7C is a diagram showing a comparison in cost and size between the high voltage drive electromagnetic fuel injection apparatus according to the prior art and the electromagnetic fuel injection apparatus according to the present invention.

FIG. 7C is a diagram showing the relative cost and size between the high voltage fuel injection apparatus according to the prior art and the electromagnetic fuel injection apparatus of this embodiment according to the present invention.

In the electromagnetic fuel injection apparatus of this embodiment according to the present invention, the step-up circuit and the current control circuit shown included in the prior art can be eliminated and the circuit scale can be made smaller in comparison with that of the prior art.

Further, in this embodiment according to the present invention, the case, the harness, and the connector included in the prior art become unnecessary. As a result, according to this embodiment according to the present invention, it is possible to achieve a large reduction in the cost and a small size structure in the injector 10.

In the fuel injector of this embodiment according to the present invention, while the voltage VL which is applied to the hold coil 12 is stabilized, and the voltage VH is not stabilized, since the drive of the control coil 11 and the hold coil 12 is suited to the respective stages of the valve opening operation and the operation for holding the valve of the injector 10 open with the application of drive voltages suited to the respective stages, it is possible to realize an optimum drive.

Further, to attain a reduction in the cost of the whole electromagnetic fuel injection apparatus, in this system according to the present invention, it is not necessary to change or stabilize the power supply voltage, since it is possible to use only the power supply which is supplied from the automobile.

One embodiment of an internal combustion engine to which the electromagnetic fuel injection apparatus of this embodiment according to the present invention is applied will be explained with reference to FIG. 8.

Figure 8:
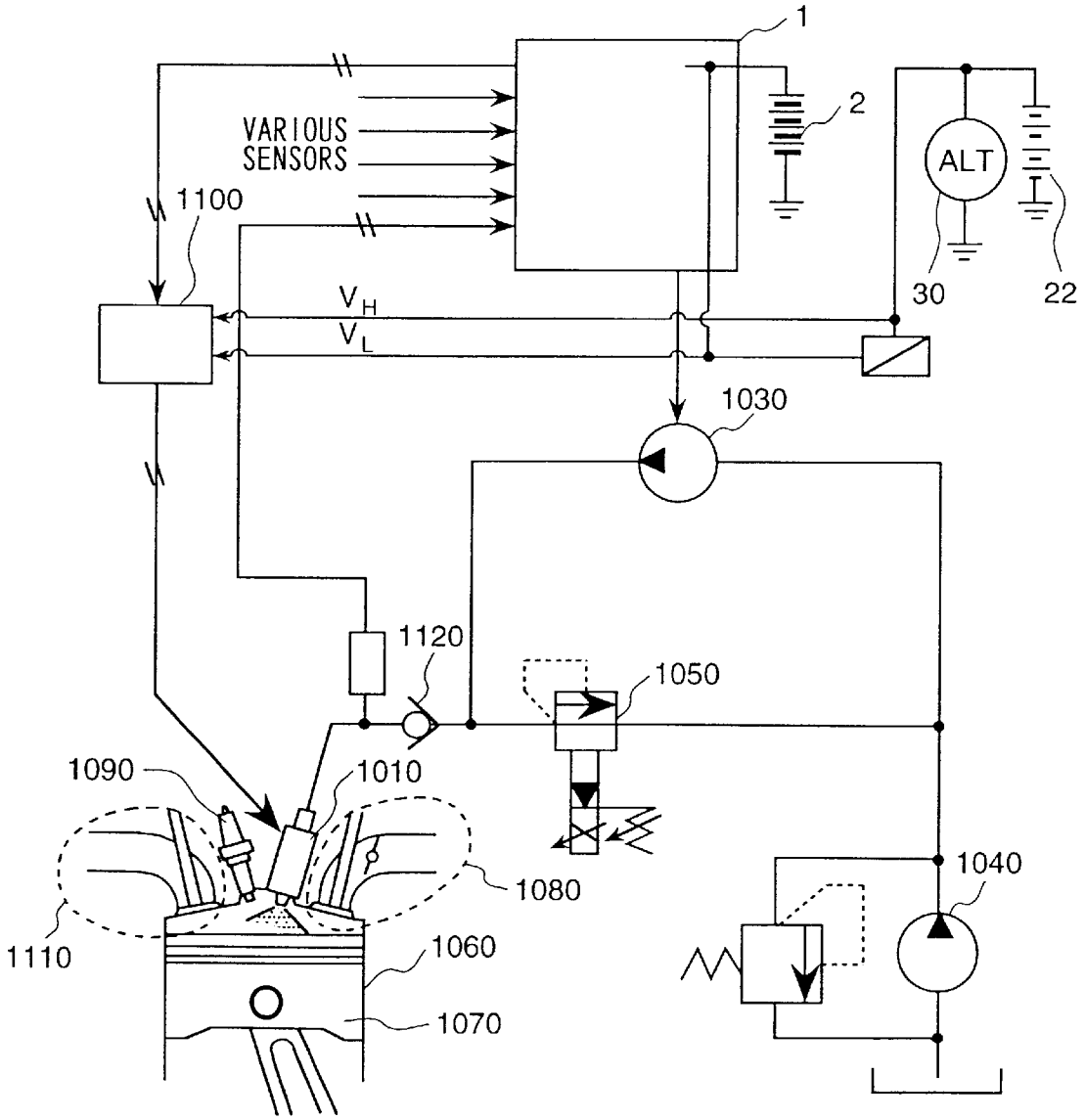
FIG. 8 is a circuit diagram of an engine control system showing an internal combustion engine having the electromagnetic fuel injection apparatus according to the present invention.

The internal combustion engine of this embodiment according to the present invention, as shown in FIG. 8, comprises a fuel injection apparatus (an electromagnetic fuel injector 1010 and a drive circuit 1100) for injecting fuel, and a fuel supply apparatus (a fuel pump 1030, a feed pump 1040, a high pressure regulator 1050) for supply of the fuel to the fuel injection apparatus.

The internal combustion engine further comprises a cylinder 1060 in which the fuel being injected by the fuel injection apparatus is burned, a piston 1070 which is reciprocated in the cylinder 1060, an air intake means 1080 for inhaling air into the cylinder 1060, an ignition apparatus 1090 for igniting an air fuel mixture in the cylinder 1060, an air exhaust means 1110 for exhausting the burned gases from the cylinder 1060, and an engine control unit 1 for controlling the air intake means (an air intake conduit, a valve, etc.) 1080, the air exhaust means (an air exhaust conduit, a valve, etc.) 1100, the ignition apparatus 1090, and the fuel injection apparatus.

Further, a generator 30 which generates a voltage by receiving a motive force of the internal combustion engine and a DC/DC convertor 40 are provided, and the voltage of 42V from the generator 30 and the voltage of 14V, which is converted and stabilized by the DC/DC convertor 40, are supplied to the drive circuit 1100.

In this internal combustion engine, having the fuel injection apparatus of the present invention, the fuel is supplied to the fuel pump 1030 through the feed pump 1040 and the fuel passes through a check valve 1120 and is supplied to the injector 1010 under a pressurized condition. The engine controller 1 determines the injection timing and the injection amount from information provided by various kinds of sensors and the injection signal is outputted to the injector drive circuit 1100, whereby the injector 1010 is driven by the drive circuit 1100 and the fuel is injected. In this embodiment according to the present invention, a direct injection type of internal combustion engine will be referred to, however other kinds of internal combustion engines may be used naturally.

In an internal combustion engine employing this embodiment according to the present invention, during the valve closing condition, the valve opening operation, the operation for holding the valve open, and the following valve closing operation, since the valve body is driven according to the respective desirable coil characteristics and the respective power supply voltages, a fuel injection apparatus which realizes stably a wide dynamic range can be provided at a low cost.

The fuel injector and the drive circuit system of the fuel injector will be explained in more detail. As a fuel injector and a drive circuit system of the injector, a saturated system (the voltage drive) and a peak hold system (the current drive) are well known.

In the typical saturated system, the coil winding number is large, the drive current continuous to increase after the lifting of the valve body is finished, and the drive current becomes close to the saturated current value, which is limited by the coil internal resistance and the resistance of the drive circuit. The circuit impedance is high compared with that of the peak hold system, and due to the influence of the inductance the rising of the current which flows in the coil is moderate.

By adjustment of the coil internal resistance and the resistance of the drive circuit, the saturated current value can be established suitably, and the current control circuit becomes unnecessary, so that the fuel injector can be constituted with a low cost.

On the other hand, in the peak hold system, the coil winding number is small, the circuit inductance and the circuit impedance are low, so that the rising of the current during the valve opening time is rapid compared with that of the saturated system. However, with this condition, since an over-current flows making it possible for the coil to be burned and damaged, a current control mechanism is provided in the drive circuit. After the full lifting of the valve, the current is limited to the value necessary for holding the valve open.

To attain a high injection rate which becomes a performance standard for the injector and offers a wide dynamic range of operation, there are many cases in which the peak hold system having the high current response performance is employed. Further, with use of a step-up circuit, a high voltage is produced and supplied to the injector, and the current compulsively flows in a short time, whereby it is possible to improve the valve opening characteristic. Further, during the time the valve is open, this high voltage is applied inversely, whereby it is possible to improve the valve closing characteristic of the injector.

According to the present invention, since at least two coils having different electric characteristics are provided and suitable power supply voltages are applied to the control coil and the hold coil, a desirable characteristic drive force of the valve body relative to the operation condition of the injector can be generated, and, accordingly, a good fuel injection can be realized.

Next, a drive circuit of an electromagnetic fuel injector representing a further embodiment according to the present invention will be explained with reference to the drawings.

Figure 9A:
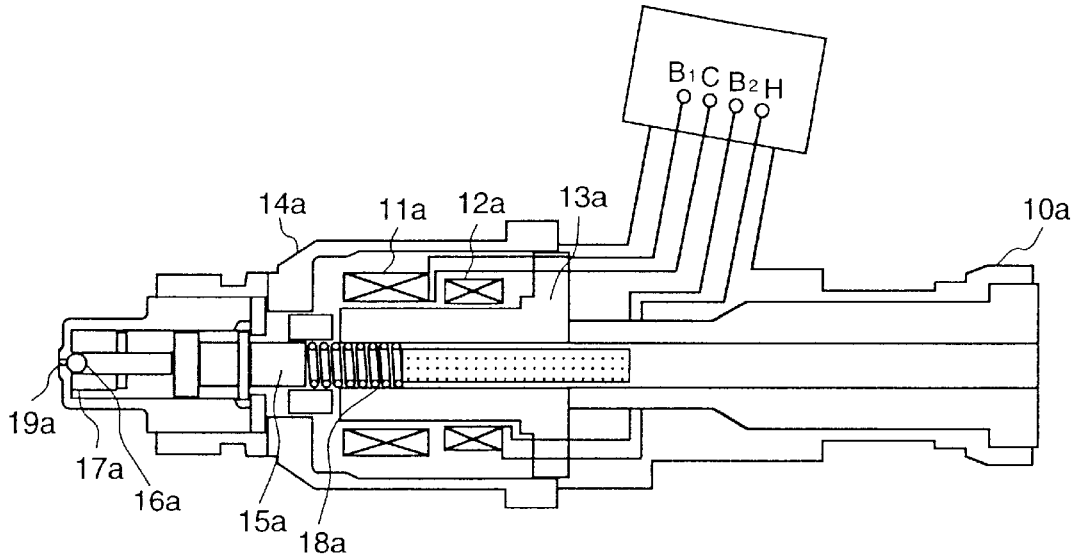
FIG. 9A is a diagram of an electromagnetic fuel injection apparatus according to the present invention.
Figure 9B:
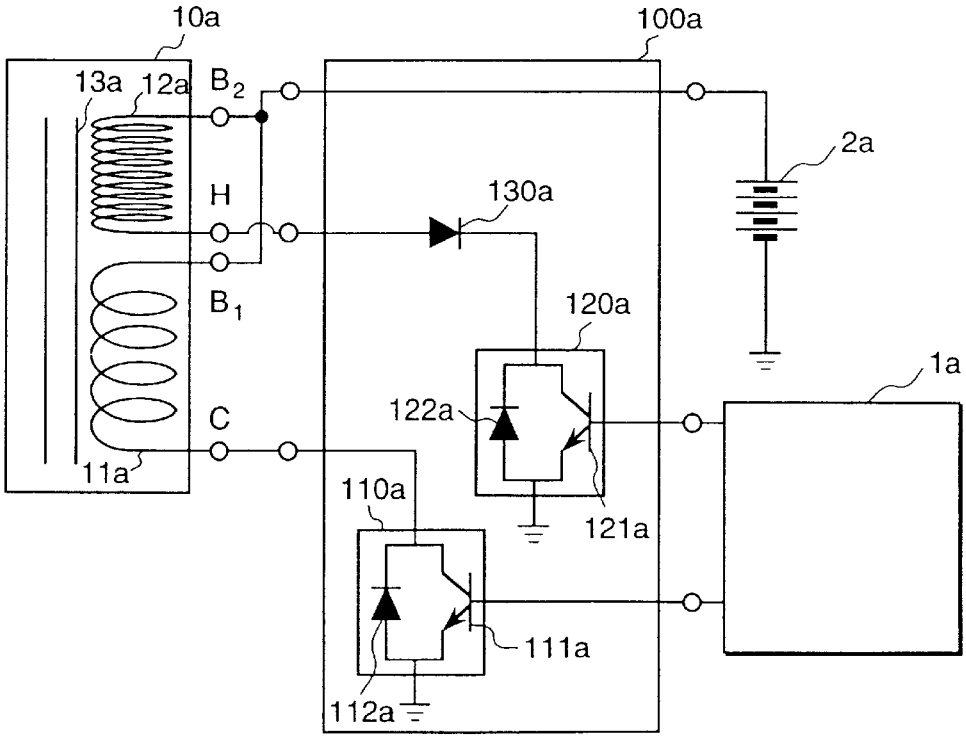
FIG. 9B is a diagram of the electromagnetic fuel injection apparatus shown in FIG. 9A according to the present invention.

FIG. 9A is a schematic view showing the structure of an injector 10*a,* and FIG. 9B is a schematic circuit diagram structure of an injector drive circuit 100*a* according to the present invention. using FIG. 9A, the structure of the injector 10*a* will be explained.

The injector 10*a* is supplied with fuel which is pressurized by a fuel pump, and an opening and a closing of a fuel passage in the injector is carried out by a ball valve 16*a* forming a valve body and a seat face (a valve seat face) 19*a* which is formed inside of a nozzle. The injection amount of the fuel from a fuel injection orifice which is formed downstream of the seat face 19*a* is controlled in accordance with the opening time of the ball valve 16*a*. The ball valve 16*a* is installed at a tip end of a plunger 15*a,* and a swirler 17*a* is provided in the vicinity of the valve seat face 16*a* for atomizing the fuel.

To drive this ball valve 16*a*, a control coil 11*a* and a hold coil 12*a* are provided in the injector 10*a*. When the control coil 11*a* and the hold coil 12*a* are supplied with a voltage, a magnetic flux is generated. This magnetic flux passes through a magnetic path consisting of a core 13*a,* a yoke 14*a,* and the plunger 15*a,* and an electromagnetic attraction force is generated between the core 13*a,* the yoke 14*a,* and the plunger 15*a*. Accordingly, the plunger 15*a* and the ball valve 16*a* are displaced toward a right side in FIG. 9A, and the fuel is injected. Further, in the injector 10*a,* when an attraction force is not being produced by the control coil 11*a* and the hold coil 12*a,* in order to close the valve by pushing the plunger 15*a* to cause the ball valve 16*a* to press against the valve seat face 19*a,* a return spring member 18*a* is provided.

One end of the control coil 11*a* forms a B1 terminal and the other end of the control coil 11*a* forms a C terminal; while, one end of the hold coil 12*a* forms a B2 terminal and the other end of the hold coil 12*a* forms a H terminal. To the B1 terminal and the B2 terminal, a positive terminal of a battery 2*a* is connected, and to the C terminal and the H terminal a minus terminal of the battery 2*a* is connected. With respect to the control coil 11*a* and the hold coil 12*a,* the coil winding manner and the coil wiring manner of both the control coil 11*a* and the hold coil 12*a* are determined so as to generate a magnetic flux in the same direction from both coils.

Next, using FIG. 9B, the wiring structure of the injector drive circuit 110*a* will be explained. The injector 10*a* is comprised of the control coil 11*a* and the hold coil 12*a,* and the control coil 11*a* and the hold coil 2*a* are constituted to have different electric characteristics. The control coil 11*a* has a small winding number (inductance) and a small electric resistance. On the other hand, the hold coil 12*a* has a large winding number and a large electric resistance. To the injector drive circuit 100*a,* a battery voltage is supplied from the battery 2*a,* and in accordance with an injection command signal from an engine controller 1*a,* the application of a voltage to the control coil 1*a* and the hold coil 12*a* is carried out.

The injector drive circuit 100*a* comprises a control coil transistor module 110*a,* which controls the application of a control voltage to the control coil 11*a,* and a hold coil transistor module 120*a,* which controls the application of a control voltage to the hold coil 12*a*. The respective transistors 110*a* and 120*a* are constituted by power transistors 111*a* and 121*a,* and surge absorption diodes 112*a* and 122*a*.

When the hold coil power transistor 111*a* and the control coil use power transistor 121*a* are driven to an "on" state, the voltage from the battery 2*a* is applied to the hold coil 12*a* and the control coil 11*a,* respectively. Further, to one side of the hold coil 12*a* a reverse flow prevention diode 130*a* is connected. This reverse flow prevention diode 130*a* is wired to have a polarity such that the current of the hold coil 12*a* is prevented from flowing reversely from the H terminal to the B2 terminal.

In the operation of the control coil 1*a* and the hold coil 12*a,* the roles of the respective stages of holding the valve closed, valve opening, holding the valve open, and valve closing of the injector 10*a* are different, respectively. The control coil 11*a* is, in this embodiment according to the present invention, a coil which is used exclusively at the valve opening initial condition, and the hold coil 12*a* is a coil which is used to hold the valve open. Hereinafter, the current characteristics of the control coil 11*a* and the hold coil 12*a* will be explained.

Figure 10A:
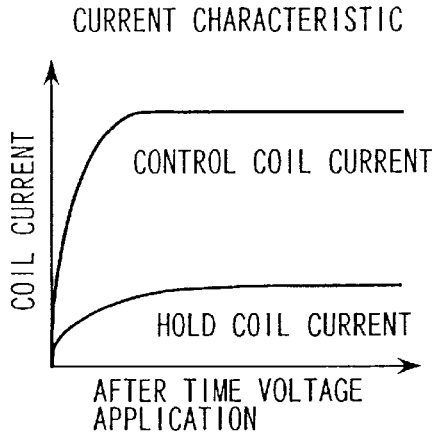
FIG. 10A is a graph showing a current characteristic of the electromagnetic fuel injection apparatus according to the present invention.

FIG. 10A is a view showing the current characteristics of the control coil 11*a* and the hold coil 12*a* in a case in which the same voltage is applied to the coils over a predetermined time period. As stated above, since the control coil 11*a* has a small winding number and a small resistance, in a short time the current flowing therein can reach a large current value. On the other hand, since the hold coil 12*a* has a large winding number and a large resistance, it takes a longer time for the current flowing therein to reach a converging current value, and the convergence value is smaller than that of the control coil 11*a*.

Figure 10B:
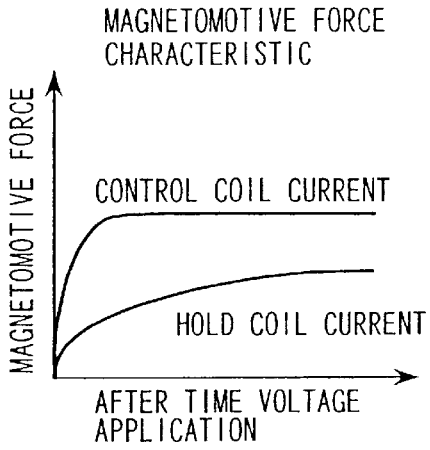
FIG. 10B is a graph showing a magnetomotive force characteristic of the electromagnetic fuel injection apparatus according to the present invention.

On the other hand, FIG. 10B is a view showing the magnetomotive force response which affects the magnetic circuit of the control coil 11*a* and the hold coil 12*a*. The magnetomotive force is expressed as a product of the coil winding number and the current value, and this is considered to be a physical value which exerts an influence directly upon the magnetic attraction force. As shown in FIG. 10B, the current which flows in the control coil 11*a* rises abruptly, but since the winding number is small, the convergence value of the magnetomotive force is not larger than the difference in the current value in comparison with the hold coil 12*a*. Inversely, the magnetomotive force response of the hold coil 12*a* is duller than that of the control coil 11*a*.

During the valve opening operation time of the injector 10*a,* since a set load is applied by the return spring member 18*a* and a fuel pressure according to the force of the pressurized fuel is applied to the ball valve, a large electromagnetic attraction force is required in comparison with the force needed to hold the valve open. When the electromagnetic attraction force reaches a valve which overcomes these forces, the plunger 15*a* starts to move. As a result, since the time necessary to generate the required electromagnetic attraction force represents a valve opening delay, it is necessary to shorten this delay time as much as possible.

On the other hand, for purposes of holding the valve open, in comparison with the valve opening operation, only a small magnetomotive force is required. This is due to the fact that, once the valve is open and the fuel is being injected, the pressure on both sides of the ball valve is balanced, so that the force on the ball valve by the fuel pressure is small. At the same time, since an air gap between the core 13*a,* the yoke 14*a* and the plunger 15*a* becomes small, the magnetic flux density of the gap is raised and the magnetomotive force can be used effectively.

Further, at the time of the valve closing following the period during which the valve is held open, the voltage application is stopped, and the magnetomotive force which existed during the time the valve was held open lowers. As a result, the magnetic force lowers, and when it becomes lower than the set load of the spring member 18*a,* the valve closing operation begins. Thus, when the magnetomotive force applied during the time valve is held open is excessively large, this contributes to the valve closing delay. Accordingly, it is necessary to hold the valve open with a low magnetomotive force which is near to the hold limit.

As stated above, at the valve opening initial stage and during the time the valve is being held open, different magnetomotive force characteristics are required. In the injection drive circuit of this embodiment according to the present invention, as shown in FIG. 10C, for an injection command signal having a length Ti, a high voltage is applied to a side of the control coil for a time length Tc (<Ti), so that in a short time, a large magnetomotive force is produced and a rapid valve opening of the injector 10*a* is promoted.

On the other hand, a voltage is applied continuously to the hold coil 12*a* for the full time duration of the injection command signal (Ti). When the injection command signal is turned off, at the same time the application of voltage to the coil 12*a* is stopped. Accordingly, at the valve opening time, the characteristic required for proper operation of the control coil 11*a* is provided, and, at the time valve is to be held open, the characteristic required for proper operation of the hold coil 12*a* is provided. By simply changing over the characteristic at the respective stages of the valve opening operation and when the valve is to be held open, it is possible to carry out an ideal operation of the injector.

Figure 10D:
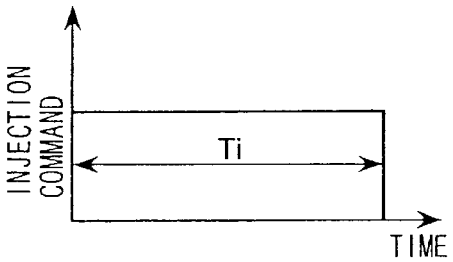
FIG. 10D is a waveform diagram showing the injection command and the magnetomotive force characteristic of the hold coil of the electromagnetic fuel injection apparatus according to the present invention.
Figure 10C:
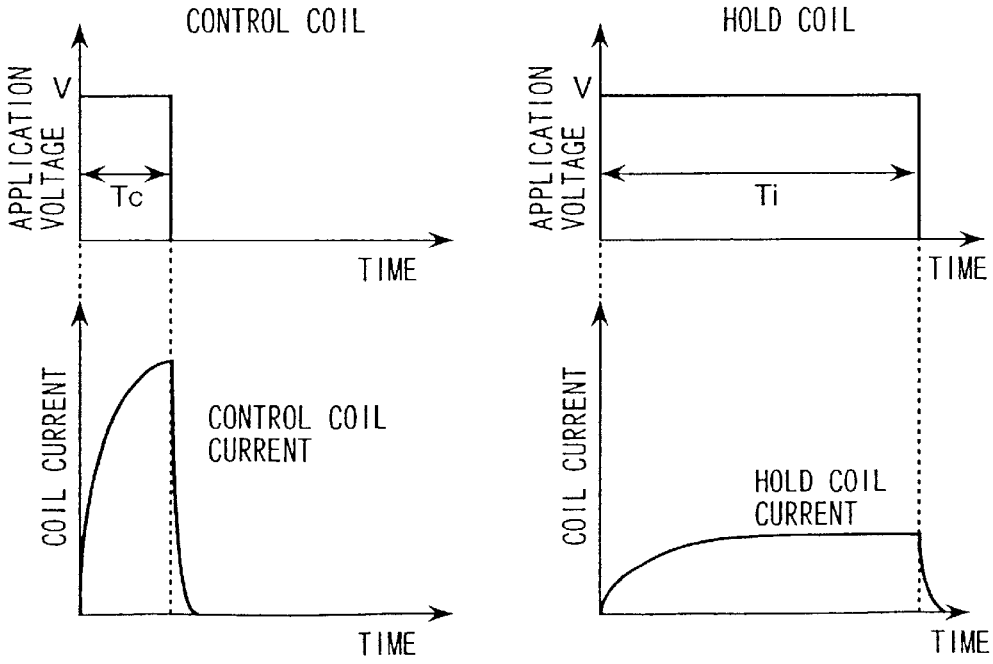
FIG. 10C is a waveform diagram showing the magnetomotive force characteristic of the control coil of the electromagnetic fuel injection apparatus according to the present invention.

Herein, FIG. 10C and FIG. 10D represent the current response of the control coil 11*a* and the current response for the hold coil 12*a,* respectively. In actuality, since the control coil 11*a* and the hold coil 12*a* are arranged to close the same magnetic circuit (the yoke, and core), there is a mutual inductance between the control coil 11*a* and the hold coil 12*a*. This mutual inductance works in a direction from which respective magnetomotive force changes are prevented. For example, when the battery voltage is applied to the control coil 11*a,* the control coil current rises abruptly, whereby, as a transfer effect according to the mutual inductance, an induction magnetomotive force which is proportional to a time change of the control coil current is generated and applied to the hold coil 12*a* (between B2 terminal and H terminal). This effect is shown schematically in FIG. 11A in the form of a voltage source connected in series with the hold coil 12*a*.

Figure 11A:
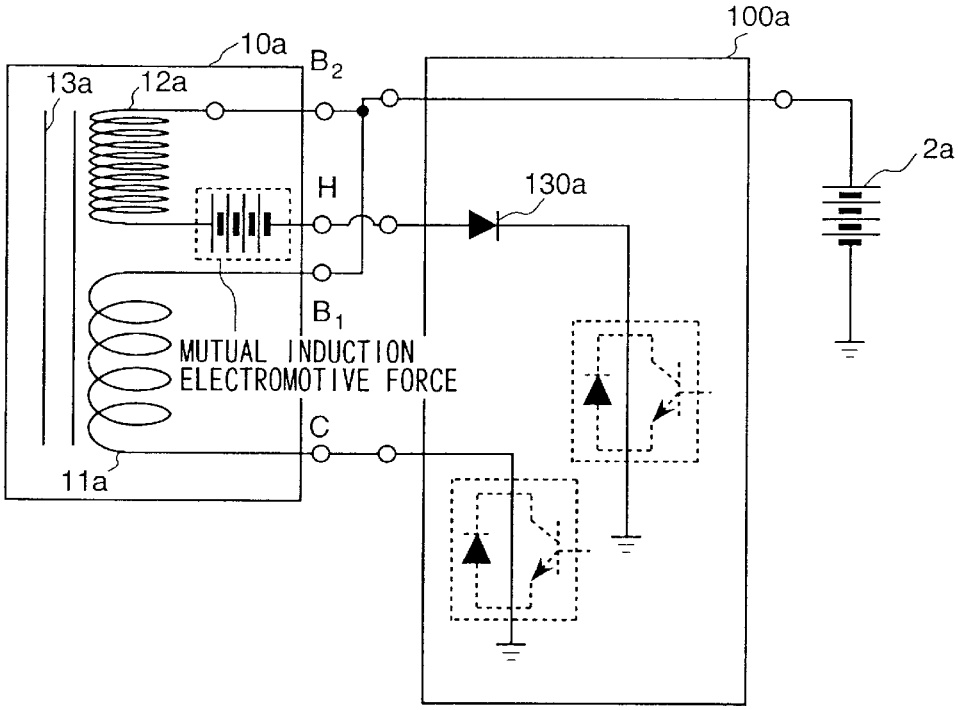
FIG. 11A is a circuit diagram showing a mutual induction electromotive force and an equivalent circuit of a control coil and a hold coil of the electromagnetic fuel injection apparatus according to the present invention.

On the other hand, the respective transistor modules of the control coil 11*a* and the hold coil 12*a* are constituted by power transistors and surge absorption diodes. Accordingly, regardless of the on and off state of the power transistors, a circuit providing a reverse flow of current in the hold coil 12*a* is constituted. Both power transistors at the valve opening initial time are switched to the "on" condition, causing the circuit to be closed in both directions. As a result, a short circuit condition as shown in FIG. 11A appears.

Figure 11B:
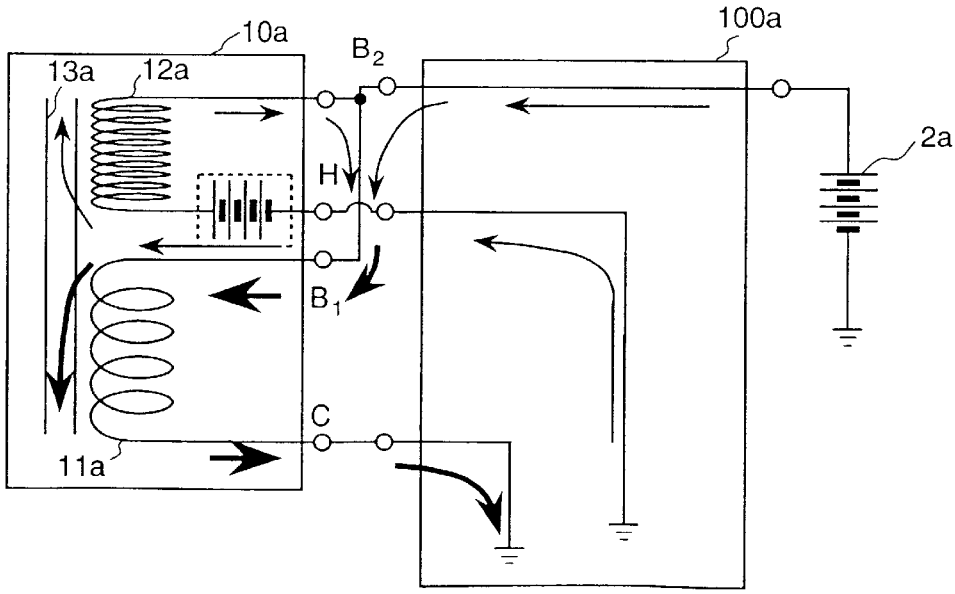
FIG. 11B is a circuit diagram showing a reverse current path of the control coil and the hold coil of the electromagnetic fuel injection apparatus according to the present invention.

Herein, as a comparison and to more clearly show the effects of using the reverse flow prevention diode 130*a* according to the present invention, as shown in FIG. 11B, it is supposed that the reverse flow prevention diode 130*a* is not provided. When the minus magnetomotive force according to the above-stated mutual inductance is larger than the battery voltage, the reverse current flow phenomenon represented by the arrows shown in FIG. 11B is created. At the valve opening initial time in which the voltage from battery 2*a* is applied to both the control coil 11*a* and the hold coil 12*a* at the same time, the hold coil current flows reversely from the H terminal to the B2 terminal, and, further, the current flows from the B2 terminal via the B1 terminal into the control coil 11*a*. Since the battery voltage is also applied to the control coil 11*a* at this time, a compound current, consisting of the current from the battery and the reverse current from the hold coil 12*a,* flows in the control coil 11*a,* so that the apparent current in the hold coil 12*a* increases.

However, the reverse current flowing in the hold coil 12*a* negates the magnetomotive force which is generated in the magnetic circuit; and, further, since the coil winding number of the hold coil 12*a* is larger than the coil winding number of the control coil 11*a,* the negating of the magnetomotive force becomes significantly large.

Figure 12A:
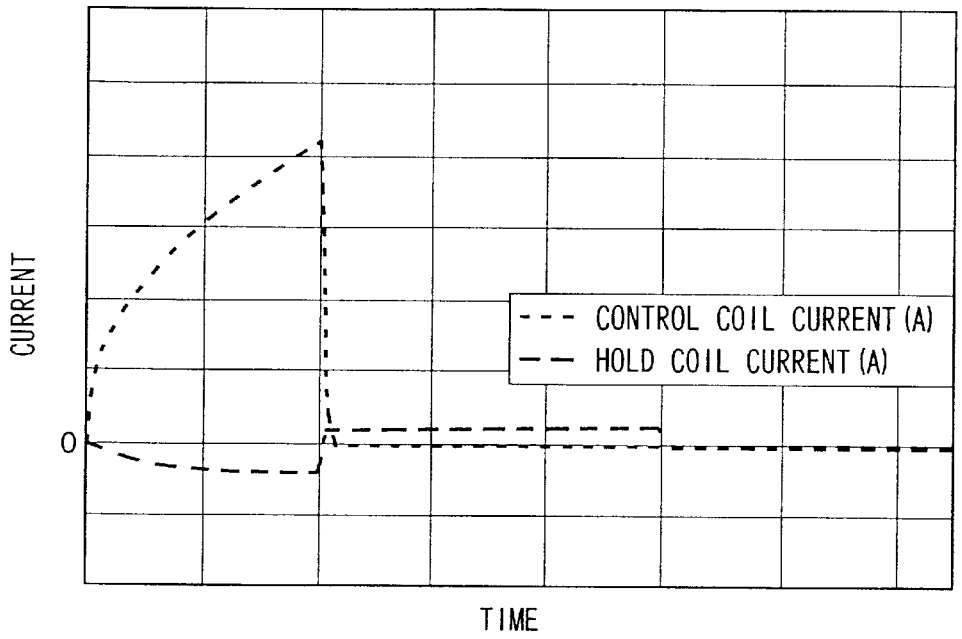
FIG. 12A is a graph showing a throw-in current in a circuit having no reverse current prevention diode.
Figure 12B:
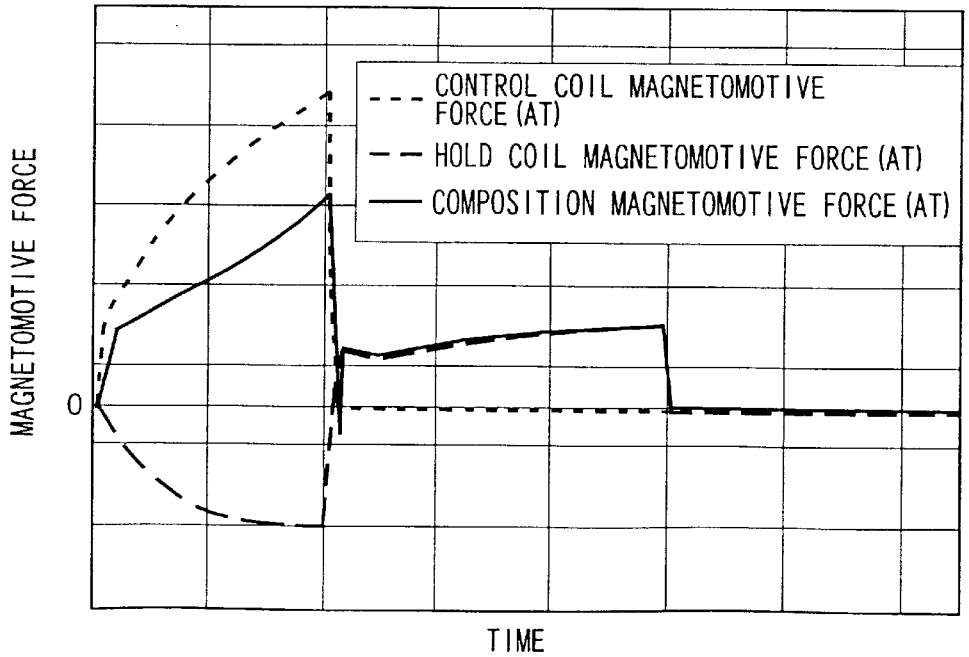
FIG. 12B is a graph showing a throw-in electromagnetic force in a circuit having no reverse current prevention diode.
Figure 13A:
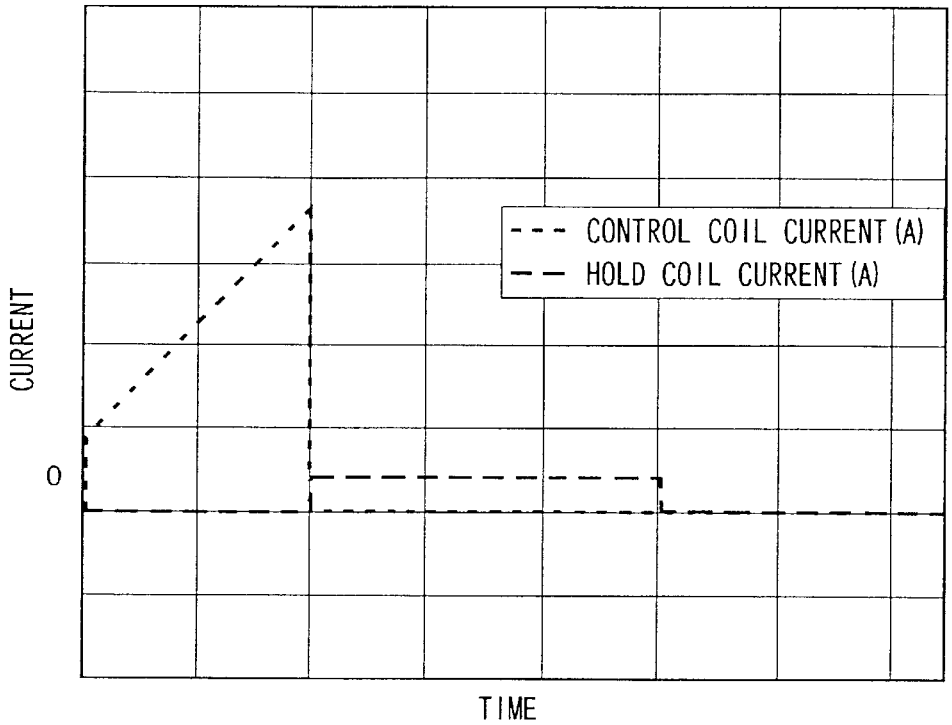
FIG. 13A is a graph showing a throw-in current in a circuit having a reverse current prevention diode.
Figure 13B:
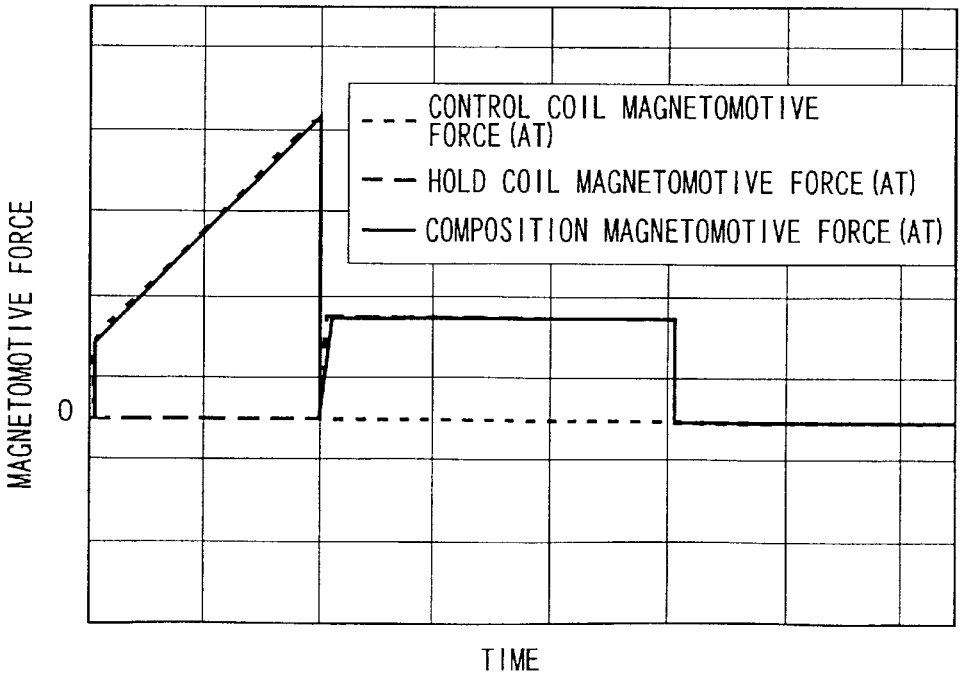
FIG. 13B is a graph showing a throw-in electromagnetic force in a circuit having a reverse current prevention diode.

FIG. 12A shows the control coil current and the hold coil current in the case where the injector of the present invention has a drive circuit in which the reverse flow diode is not provided, and FIG. 12B shows the throw-in electromagnetic force generated by the control coil 11*a* and the hold coil 12*a* and a compound value thereof.

During the time the control coil is connected to the battery 2*a,* since the control coil current rises abruptly, a minus induction magnetomotive force is generated in the hold coil 12*a*. However, if the reverse current prevention diode 130*a* is provided, the current and the magnetomotive force do not become minus, but become zero. Thus, a reverse current from the hold coil 12*a* does not flow into the control col 11*a*. This, in contrast to the case where the reverse flow prevention diode is not provided, the maximum value of the current is made small. Further, the rise of the electromagnetic force of the hold coil after the end of the control coil operation can be improved.

As stated above, by the insertion of the reverse flow prevention diode 130*a* in the injector 10*a,* it is possible to improve the throw-in effect of the electromagnetic force, and to reduce the valve opening delay, while also ensuring a proper holding of the valve in the open state during fuel injection.

In this embodiment according to the present invention, in the drive circuit of the injector having the control coil 11*a* and the hold coil 12*a,* the reverse flow prevention diode is provided only in connection with the hold coil, however a reverse flow prevention diode can be inserted in connection with the control coil as well. In the drive circuit of an injector having more than three coils, by the insertion of the reverse flow prevention diode in the drive circuit line of the coil in which a reverse flow is generated, it is possible to improve the throw-in efficiency of the electromagnetic force.

In this embodiment according to the present invention, the battery voltage is applied directly to the control coil 11*a* and the hold coil 12*a,* however a power supply in which the voltage is stepped-up or stepped-down may be employed without departing from the spirit of the present invention.

According to the present invention, in an electromagnetic fuel injection apparatus having plural coils, it is possible to provide a drive circuit in which a reverse current does not flow in a direction which will cause the magnetic flux of one coil to weaken the magnetic flux of another coil according to the mutual induction of the control coil and the hold coil. Since the throw-in efficiency of the electromagnetic force is improved as a result, a reduction in the valve opening delay and a safe holding of the injector in the open state can be realized.

What is claimed is:

1. An electromagnetic fuel injection apparatus comprising an electromagnetic fuel injector and a drive circuit for driving said electromagnetic fuel injector, said electromagnetic fuel injector having at least two coils which produce a different time change rate of magnetomotive force, and wherein, to said at least two coils, a different voltage is applied via said drive circuit, each of said at least two coils being coupled to a respective power supply having a different voltage.

2. An electromagnetic fuel injection apparatus comprising an electromagnetic fuel injector and a drive circuit for driving said electromagnetic fuel injector, said electromagnetic fuel injector having at least two coils having a different winding number, and wherein, to said at least two coils, a different voltage is applied via said drive circuit, each of said at least two coils being coupled to a respective power supply having a different voltage.

3. An electromagnetic fuel injection apparatus comprising an electromagnetic fuel injector and a drive circuit for driving said electromagnetic fuel injector, said electromagnetic fuel injector having at least two coils having a different length, and wherein, to said at least two coils, a different voltage is applied via said drive circuit, each of said at least two coils being coupled to a respective power supply having a different voltage.

4. An electromagnetic fuel injection apparatus comprising an electromagnetic fuel injector and a drive circuit for driving said electromagnetic fuel injector, said electromagnetic fuel injector having at least two coils having a different cross-sectional area of wire material, and wherein, to said at least two coils, a different voltage is applied via said drive circuit, each of said at least two coils being coupled to a respective power supply having a different voltage.

5. An electromagnetic fuel injection apparatus comprising an electromagnetic fuel injector and a drive circuit for driving said electromagnetic fuel injector, said electromagnetic fuel injector having at least two coils having a different electric resistance value between terminals thereof, and wherein, to said at least two coils, a different voltage is applied, each of said at least two coils being coupled to a respective power supply having a different voltage.

6. An electromagnetic fuel injection apparatus according to any one of claim 1 to claim 5, wherein to one of said at least two coils which has a large time change rate of magnetomotive force, a high voltage is applied, and to another of said at least two coils which has a small time change rate of magnetomotive force, a low voltage is applied.

7. An electromagnetic fuel injection apparatus comprising an electromagnetic fuel injector and a drive circuit for driving said electromagnetic fuel injector, said electromagnetic fuel injector having a fuel injection orifice, a seat valve provided upstream of said fuel injection orifice, a valve body for performing an opening and closing of a fuel passage between said valve seat and said valve body, and at least two coils for generating a drive force to effect movement of said valve body, including a first coil having a large time rate of change of magnetomotive force, which is a product of a winding number and a current valve, and a second coil having a smaller time rate of change of magnetomotive force than that of said first coil, wherein said drive-circuit includes a first switching means for performing an on and off application of a first voltage to said first coil and a second switching means for performing an on and off application of a second voltage, which is lower than said first voltage, to said second coil, said first switching means being different than said second switching means.

8. An electromagnetic fuel injection apparatus comprising an electromagnetic fuel injector, a drive circuit for driving said electromagnetic fuel injector and a control circuit for sending a control signal to said drive circuit, said electromagnetic fuel injector having a fuel injection orifice, a seat valve provided upstream of said fuel injection orifice, a valve body for performing an opening and closing of a fuel passage between said valve seat and said valve body, and at least two coils for generating a drive force of said valve body, including a first coil having a large time rate of change of magnetomotive force, which is a product of a winding number and a current value, and a second coil having a smaller time rate of change of magnetomotive force than that of said first coil, wherein said drive circuit includes a first switching means for performing an on and off application of a first voltage to said first coil and a second switching means for performing an on and off application of a second voltage, which is lower than said first voltage, to said second coil, and wherein, at a valve opening operation initial stage of said valve body, said first voltage is applied to said first coil and said second voltage is applied to said second coil to generate a magnetic flux having the same direction, and, after a predetermined time, only said second coil is energized, said first switching means being different than said second switching means.

9. An electromagnetic fuel injection apparatus according to claim 7 or claim 8, further including a circuit for stabilizing said second voltage.

10. An electromagnetic fuel injection apparatus according to claim 1 or claim 8, wherein said drive circuit is installed in an interior portion of an engine control unit which controls an operation condition of an internal combustion engine.

11. An internal combustion engine having an electromagnetic fuel injection apparatus for injecting a fuel, a fuel supply means for supplying the fuel to said fuel injection apparatus, a cylinder for burning the fuel injected by said fuel injection apparatus, an air intake means for supplying air to said cylinder, an ignition means for igniting an air-fuel mixture in said cylinder, an air exhaust means for exhausting an exhaust gas from said cylinder, and an engine control unit for controlling said air intake means, said air exhaust means, said ignition means and said fuel injection apparatus; said electromagnetic fuel injection apparatus comprising an electromagnetic fuel injector and a drive circuit for driving said electromagnetic fuel injector, said electromagnetic fuel injector having a fuel injection orifice, a seat valve provided upstream of said fuel injection orifice, a valve body for performing an opening and closing of a fuel passage between said valve seat and said valve body, and at least two coils for generating a drive force of said valve body, including a first coil having a large time rate of change of magnetomotive force, which is a product of a winding number and a current value, and a second coil having a smaller time rate of change of magnetomotive force than that of said first coil, wherein said drive circuit includes a first switching means for performing an on and off application of a first voltage to said first coil and a second switching means for performing an on and off application of a second voltage, which is lower than said first voltage, to said second coil, and wherein said second voltage is a lower voltage than said first voltage, said first switching means being different than said second switching means.

12. An internal combustion engine having an electromagnetic fuel injection apparatus for injecting a fuel, a fuel supply means for supplying the fuel to said fuel injection apparatus, a cylinder for burning the fuel injected by said fuel injection apparatus in at an interior portion a fuel injection apparatus, an air intake means for supplying air to said cylinder, an ignition means for igniting an air-fuel mixture in said cylinder, an air exhaust means for exhausting an exhaust gas from said cylinder, and an engine control unit for controlling said air intake means, said air exhaust means, said ignition means and said fuel injection apparatus; said electromagnetic fuel injection apparatus comprising an electromagnetic fuel injector and a drive circuit for driving said electromagnetic fuel injector, said electromagnetic fuel injector a fuel injection orifice, a seat valve provided upstream of said fuel injection orifice, a valve body for performing an opening and closing of a fuel passage between said valve seat and said valve body, and at least two coils for generating a drive force to effect movement of said valve body, including a first coil having a large time rate of change of magnetomotive force, which is a product of a winding number and a current value, and a second coil having a smaller time rate of change of magnetomotive force than that of said first coil, a first power supply for supplying a first voltage to said first coil and a second power supply for supplying a second voltage to said second coil, wherein said first power supply applies said first voltage having a high voltage to said first coil and said second power supply applies said second voltage having a lower voltage than said first voltage of said first power supply to said second coil, said first switching means being different than said second switching means.

* * * * *